US007121572B1

(12) United States Patent
Jaffe et al.

(10) Patent No.: US 7,121,572 B1
(45) Date of Patent: Oct. 17, 2006

(54) WHEELCHAIR FOOT STABILIZER ASSEMBLY

(76) Inventors: Susan K. Jaffe, 706 10th St., Mukilteo, WA (US) 98275-1926; Darryl E. Esterline, 704 10th St., Mukilteo, WA (US) 98275-1926

( * ) Notice: Subject to any disclaimer, the term of this patent is extended or adjusted under 35 U.S.C. 154(b) by 112 days.

(21) Appl. No.: 10/739,587

(22) Filed: Dec. 18, 2003

(51) Int. Cl.
*A47C 7/50* (2006.01)

(52) U.S. Cl. ..... 280/304.1; 128/882; 297/423.1

(58) Field of Classification Search ..... 280/250.1, 280/204.1; 36/131, 124, 58.5, 58.6; 128/882, 128/893; 297/466, 464, 423.1, 423.29, 423.39; 74/594.6, 564; 180/90.6; 482/70, 79; 248/228.3, 248/228.6, 229.12; 403/293, 292; 29/522
See application file for complete search history.

(56) References Cited

U.S. PATENT DOCUMENTS

| | | | | | |
|---|---|---|---|---|---|
| 639,132 | A | * | 12/1899 | Avery | 74/594.6 |
| 1,120,460 | A | * | 12/1914 | Dunlap | 74/563 |
| 2,202,187 | A | * | 5/1940 | Chalette | 601/32 |
| 2,641,249 | A | * | 6/1953 | Brockman | 601/36 |
| 2,776,495 | A | * | 1/1957 | Dickey | 33/371 |
| 3,217,833 | A | * | 11/1965 | Smith | 182/3 |
| 3,367,327 | A | * | 2/1968 | Rybczynski | 128/882 |
| 4,243,265 | A | | 1/1981 | Hanik | |
| 4,463,985 | A | | 8/1984 | Kynast | |
| 4,523,769 | A | * | 6/1985 | Glaser et al. | 280/252 |
| 4,846,156 | A | * | 7/1989 | Kopnicky | 601/36 |
| 5,005,825 | A | * | 4/1991 | Fogel | 482/60 |
| 5,052,128 | A | * | 10/1991 | Lonardo | 36/11.5 |
| 5,401,045 | A | | 3/1995 | Foerster | |
| 5,711,397 | A | * | 1/1998 | Flora et al. | 182/3 |
| 6,010,468 | A | | 1/2000 | Grove | |
| 6,371,891 | B1 | | 4/2002 | Speas | |
| 6,371,892 | B1 | * | 4/2002 | Dreissigacker et al. | 482/72 |
| 6,422,653 | B1 | | 7/2002 | Szczepanski | |
| 6,543,854 | B1 | | 4/2003 | Finch | |

* cited by examiner

*Primary Examiner*—Anne Marie Boehler
(74) *Attorney, Agent, or Firm*—Todd N. Hathaway

(57) ABSTRACT

A wheelchair foot stabilizer assembly attachable to a wheelchair foot plate is constructed having a foot stabilizer, a heel guard and a stabilizer attaching assembly. The foot stabilizer is provided with a covering that extends over the top of the front part of a foot resting on the wheelchair foot plate to secure the front part of the foot on the wheelchair foot plate. The heel guard is provided with an arcuate-shaped plate whose concave side faces and is adjacent the heel of the foot. The stabilizer attaching assembly has a rear bracket member that attaches to the rear edge of the wheelchair foot plate and a front bracket member that attaches to the front edge of the wheelchair foot plate, The stabilizer attaching assembly also is provided with a connector attached to both the rear bracket member and the front bracket member in a manner to permit them to moved toward each other to more firmly secure them to the wheelchair foot plate.

15 Claims, 3 Drawing Sheets

WHEELCHAIR FOOT STABILIZER ASSEMBLY

BACKGROUND OF THE INVENTION

1. Field of the Invention

This invention relates in general to footrests, and more particularly to footrests for use on wheelchairs.

2. Prior Art

Most wheelchairs are provided with either two attachable footrest assemblies or foot platform footrests, each having one footrest on which the person sitting in the wheelchair can place his or her feet. However, if the person has certain physical disabilities that cause a foot to twitch or spasm it may become difficult for that person to maintain his or her feet on the footrest. This is also true for persons with severe arthritis who have little control over the movement of their legs or feet. To better adapt the use of wheelchairs for such persons certain footrests have been provided with foot stabilizer assembly into which the front part of a person's foot can be placed to provide greater stability to the foot and impede uncontrolled foot movement.

However, there remains a need to convert conventional wheelchair footrests to ones that can better maintain the feet on the wheelchair footrests.

SUMMARY OF THE INVENTION

Therefore, one object of this invention is to provide a foot stabilizer that is attachable to any wheelchair footrest.

Another object of this invention is to provide a foot stabilizer attachable to a wheelchair footrest that provides increased stability to the foot placed on the footrest.

Other objects and advantages of this invention shall become apparent from the ensuing descriptions of the invention.

Accordingly, a foot stabilizer assembly is constructed having a foot stabilizer comprising a covering forming a pocket or canopy into which the front portion of a foot can be placed, a heel support member comprising a plate having a concave side facing the heel, and an stabilizer attaching assembly to fix the foot stabilizer and the heel support member to the wheelchair footrest. In a preferred embodiment the stabilizer attaching assembly includes a rear bracket member separated from a front bracket member. Each bracket member has one end forming a U-shaped channel into which the rear and forward side edges of the wheelchair footrest can be positioned. The stabilizer attaching assembly also includes a connecting member connectable to the rear and front bracket members in a manner to draw them toward one another to hold the wheelchair footrest securely in the U-shaped channels in a manner to affix the foot stabilizer assembly to the footrest.

BRIEF DESCRIPTION OF THE DRAWINGS

The accompanying drawings illustrate a preferred embodiment of this invention. However, it is to be understood that this embodiment is not intended to be exhausting, nor limiting of the invention. They are but examples of some of the forms in which the invention may be practiced.

PREFERRED EMBODIMENTS OF THE INVENTION

Without any intent to limit the scope of this invention, reference is made to the figures in describing the preferred embodiments of the invention.

Figure 1:
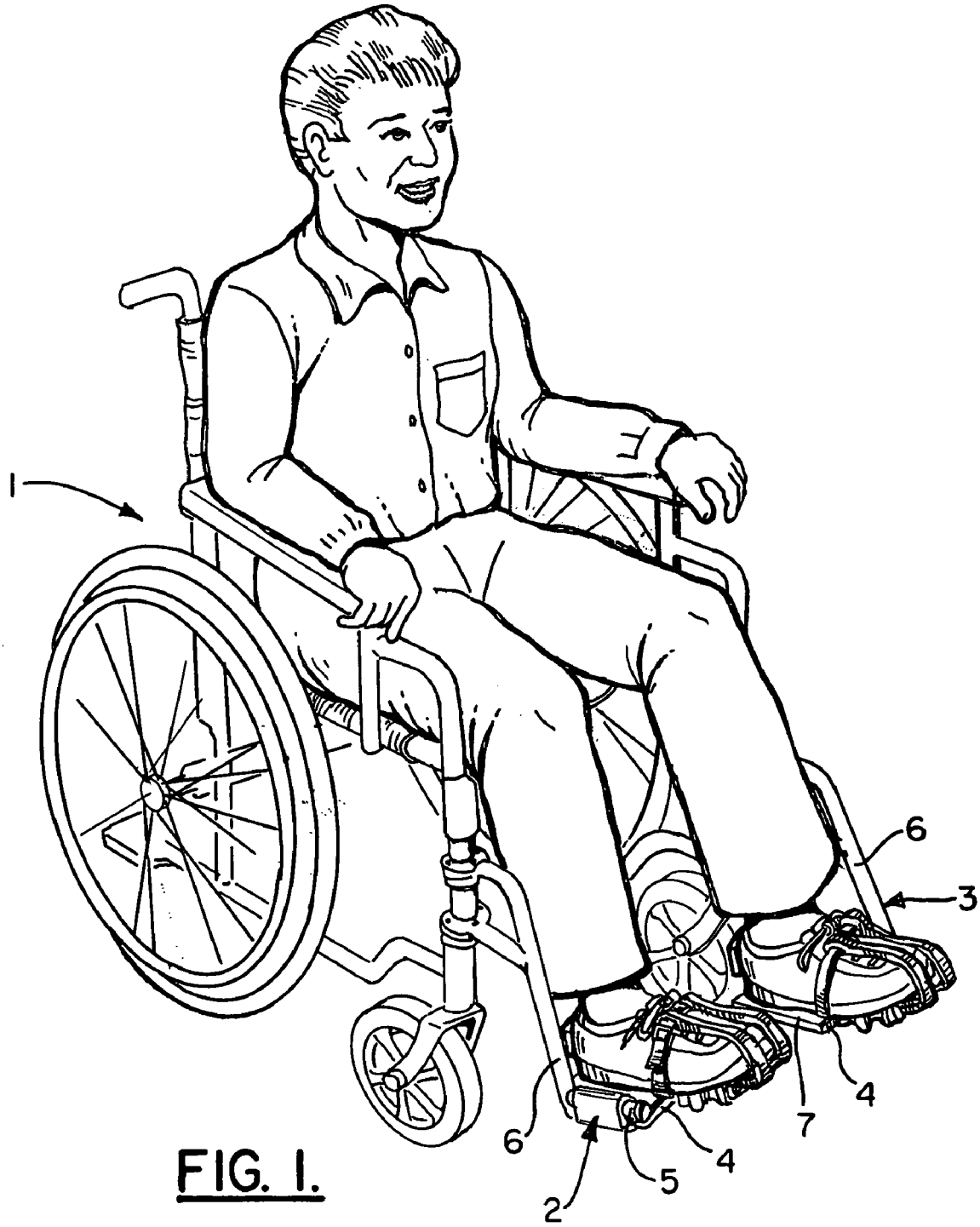
FIG. 1 is a three-quarter perspective view of a preferred embodiment of a person using the foot stabilizer assembly that has been attached to a wheelchair footrest.

Referring to FIG. 1, a conventional wheelchair 1 is depicted having footrest assemblies 2 and 3. Each footrest assembly has a plate 4 on which a person's feet can be placed. The plate 4 is mounted on the horizontally positioned extension 5 of tubing leg member 6. Plate 4 can be pivoted about extension 5 to cause inside side edge 7 of plate 4 to be pivoted upward and out of the way to permit a person sitting in the wheelchair to stand up.

Figure 2:
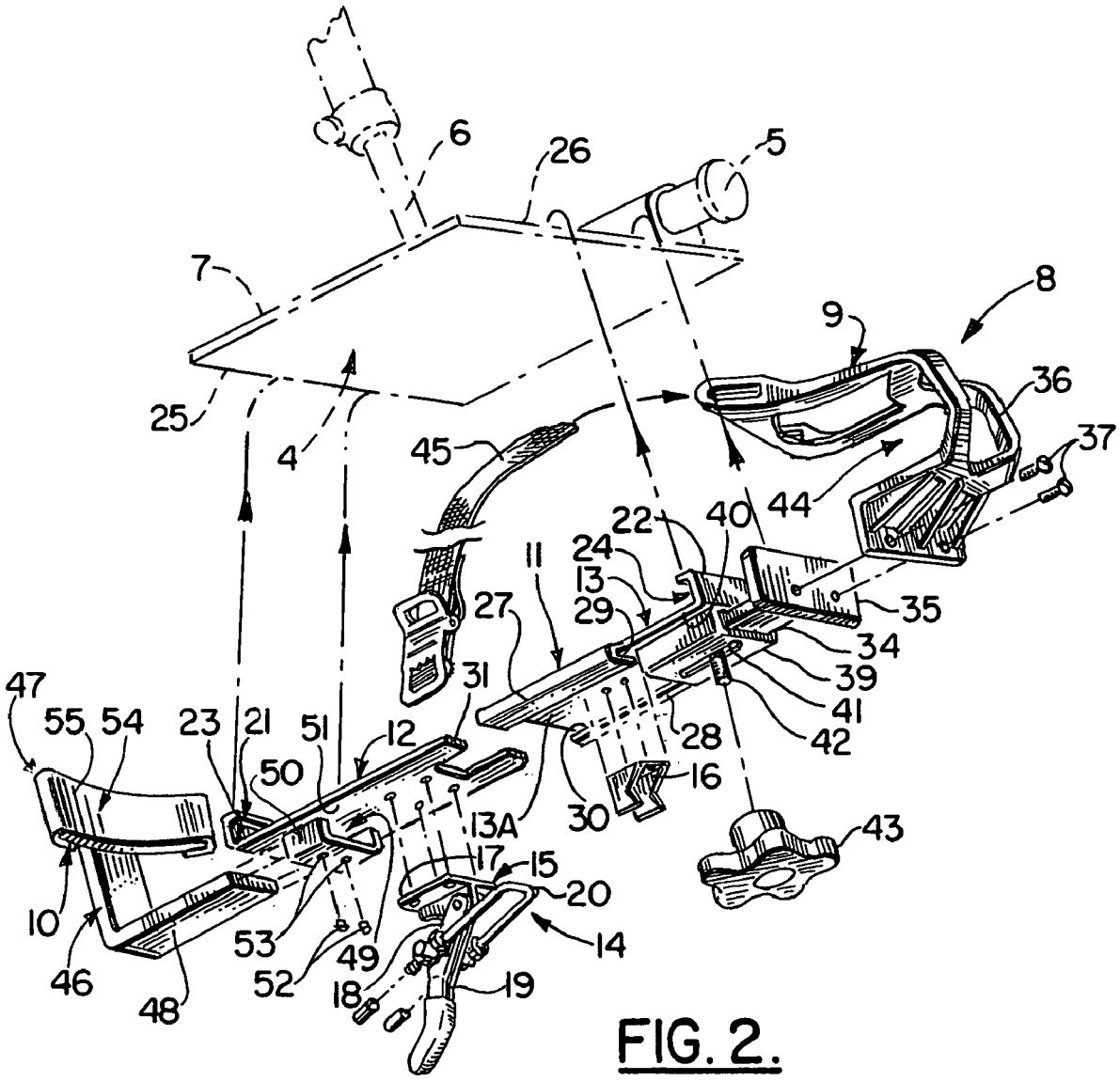
FIG. 2 is an exploded view of the foot stabilizer assembly.
Figure 3:
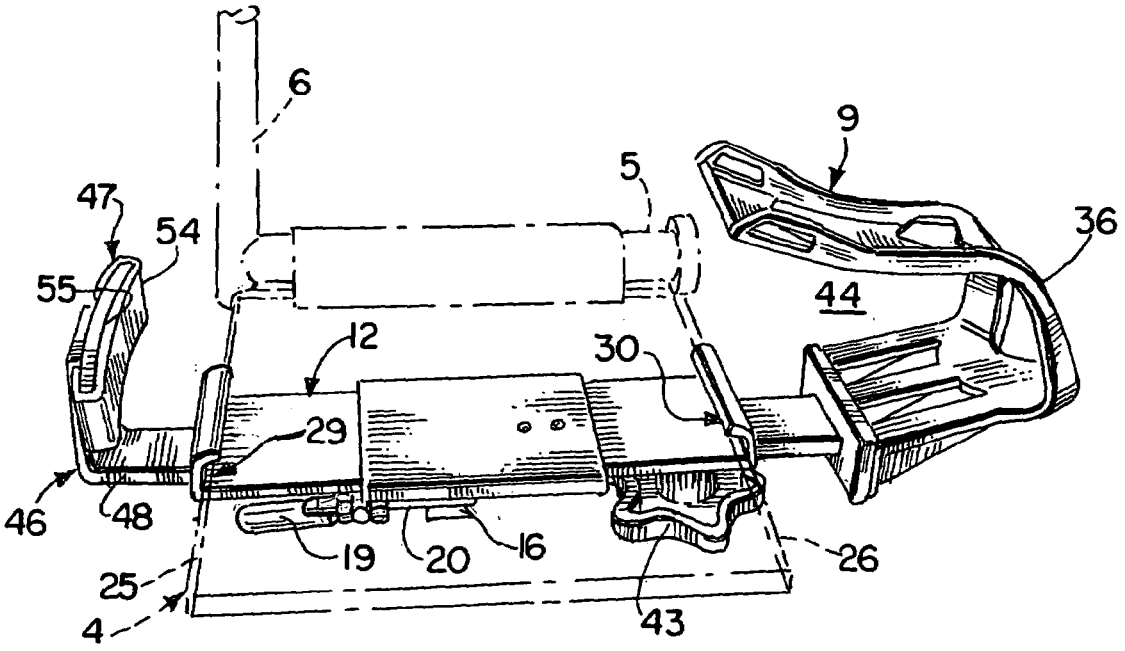
FIG. 3 is a three-quarter top perspective view of the preferred embodiment of the foot stabilizer assembly shown in FIG. 1.
Figure 4:
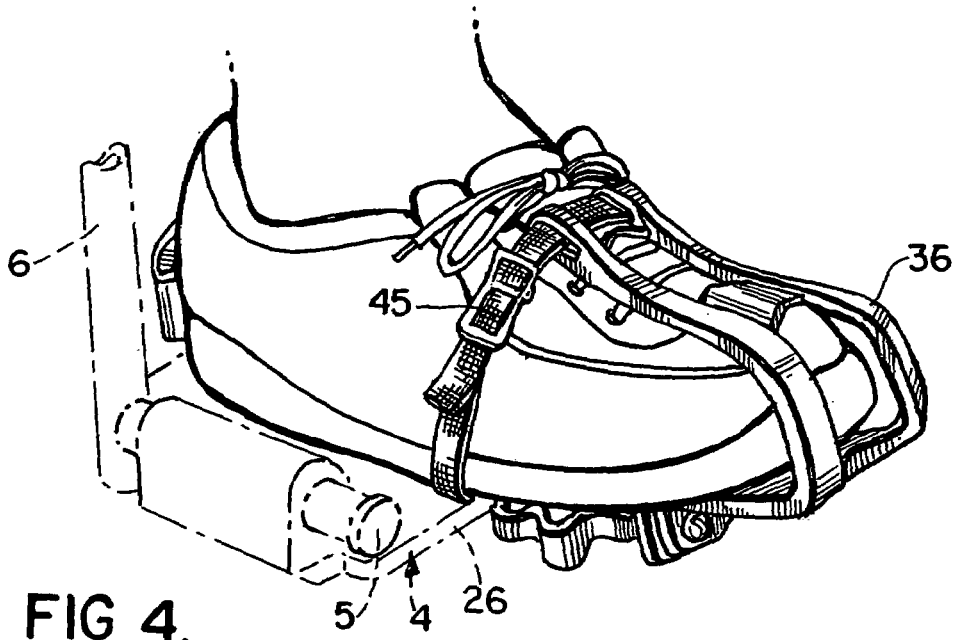
FIG. 4 is a three-quarter perspective view of the preferred embodiment of the foot stabilizer assembly shown in FIG. 1.

Referring to FIGS. 2–4 a preferred embodiment of the invention is disclosed. The invention is directed to a foot stabilizer assembly 8 that can be attached to plate 4 to better immobilize a person's foot from slipping off plate 4. Foot stabilizer assembly 8 includes a foot stabilizer 9, a heel support member 10 and a stabilizer attaching assembly 11 to which both foot stabilizer 9 and heel support member 10 can be fixed. It is preferred that stabilizer attaching assembly 11 be constructed to permit its attachment to varied size and shape plates 4.

The stabilizer attaching assembly 11 consists of a rear bracket member 12, a front bracket member 13 and connector 14. The connector 14 connects the rear bracket member 12 and front bracket member 13 in a manner to lock the two members 12 and 13 to plate 4. Connector 14 can include any number of well known connecting devices. This would include the latch clamp assembly 15 shown. Latch clamp assembly 15 includes catch 16 affixed to the bottom surface 13A of front bracket member 13. It also includes attaching member 17 having a perpendicular plate 18 to which actuating lever arm 19 is pivotly mounted, as well as a U-shaped latch 20 pivotly mounted to lever arm 19 to extend toward catch 16 and fit snugly about catch 16 when lever arm 19 is pivoted backward and away from catch 16 to a locking position.

Front bracket member 13 is constructed having a portion of its opposite side edges 27 and 28, respectively, bent to form two parallel channels 29 and 30, respectively, sized to permit the front section 31 of rear bracket member 12 to slide into channels 29 and 30 until end sections 21 and 22 contact plate edges 25 and 26, respectively.

In the preferred embodiment each member 12 and 13 has one end section 21 and 22, respectively, bent to form a U-shaped channel 23 and 24, respectively, into which the rear edge 25 or the front edge 26, respectively, of foot plate 4 can be positioned.

Toe securing foot stabilizer assembly 9 comprises a mounting plate 34 having a shank 35 extending perpendicularly therefrom, and a front foot cover 36 attached to mounting plate 34 by screws 37. In a preferred embodiment shank 35 is an elongated flat bar sized to fit into channel 38 formed by U-shaped member 39 affixed to bottom surface 40 of front bracket member 13. Member 35 is provided with a slot 41 through which threaded stud 42 can extend to permit foot stabilizer assembly 8 to be extended from or retracted toward end section 22 to a desired position to accommodate the person's foot that is placed on foot plate 4. Foot stabilizer assembly 8 is then fixed into the desired position by screwing star knob 43 down on threaded stud 42.

It is preferred that front foot cover 36 be constructed to extend over foot plate 4 to form a pocket 44 into which a foot may be inserted. It is also preferred that front foot cover 36 have sufficient flexibility to permit different size feet to fit into pocket 44. In a more preferred embodiment a securing strap 45 is affixed to front foot cover 36 and has sufficient length to extend around the front part of the foot. Strap 45 is preferably adjustable in length. This feature may be accomplished by known construction. Examples of such construction would include the utilization of elastic material to construct strap 45 or utilization of a conventional buckle or Velcro® assembly. Strap 45 should be adjustable to permit the foot to be securely positioned and held in pocket 40.

Heel securing foot stabilizer assembly 10 comprises a L-shaped bar 46 and a heel support 47. One leg 48 of bar 46 fits into channel 49 formed by U-shaped member 50 affixed to bottom surface 51 of rear bracket member 12. Heel support 47 is fixed at the desired position by sliding leg 48 in channel 49 and then fixing leg 48 screwing set screws 52 through threaded openings 53 in member 50 until they contact leg 48.

It is preferred that heel support 47 be an arcuate-shaped plate positioned to receive the back of a person's heel. In a more preferred embodiment a cushion pad 54 is affixed to the arcuate-shaped surface 55 of the plate to minimize an injury to the heel when there is a sudden movement of the foot that has been secured in the foot stabilizer 9. Pad 54 can be constructed of a resilient rubber or similar material having sufficient rigidity to provide support against the heel to prevent the foot from sliding out of front foot covering pocket 44.

To secure foot stabilizer assembly 8 to foot plate 4 members 12 and 13 are positioned to permit foot plate edges 25 and 26 to be inserted in channels 29 and 30. Once the foot plate is positioned then lever arm 19 is pivoted backward to lock latch 20 securely about catch 16. With the person sitting in wheelchair 1 the toe section of each foot is positioned in the toe pocket 44. With the foot resting on foot plate 4, strap 45 is secured around the foot as illustrated in FIG. 4.

There are of course other alternate embodiments which are obvious from the foregoing descriptions of the invention which are intended to be included within the scope of the invention as defined by the following claims.

We claim:

1. A foot stabilizer assembly for attachment to a wheelchair foot plate comprising:

(a) a foot stabilizer having a covering sized to be positioned over the front portion of a foot on the wheelchair foot plate;

(b) a heel guard having an arcuate-shaped plate with its concave side positioned to face the back of a heel of the foot on the wheelchair foot plate; and (c) a stabilizer attaching assembly comprising a rear bracket member having an attachment portion for detachably engaging a rearward edge of the wheelchair foot plate a front bracket member having an attachment portion for detachably engaging a forward edge of the wheelchair foot plate, the front bracket member being separated from the rear bracket member and a connector attachable to the rear bracket member and the front bracket member to reduce the separation between the rear bracket member and the front bracket member so as to draw the attachment portions of the bracket members into engagement with the edges of the wheelchair footplate and thereby secure the stabilizer attaching assembly to the wheelchair foot plate.

2. A foot stabilizer assembly according to claim 1 wherein the covering has an interior surface provided with cushioning material.

3. A foot stabilizer assembly according to claim 1 wherein the covering is constructed at least in part from elastic material.

4. A foot stabilizer assembly according to claim 1 wherein the heel plate has a concave surface provided with cushioning material.

5. A foot stabilizer assembly according to claim 1 wherein the connector comprises a first lug attached to the rear bracket member and a second lug attached to the front bracket member, the rear bracket member and the front bracket member being provided with openings aligned with one another when the rear bracket member and the front bracket member are attached to the wheelchair foot plate to permit an adjusting bolt operatively affixed through the aligned openings to reduce the separation between the rear bracket member and the front bracket member to secure the stabilizer attaching assembly to the wheelchair foot plate.

6. A foot stabilizer assembly according to claim 1, wherein the connector comprises a latch clamp assembly having a catch that is mounted to one of the bracket members, a lever arm that is pivotally mounted to the other of the bracket members, and a latch interconnecting the catch and lever arm to permit actuation of the lever arm to reduce the separation between the front bracket member and the rear bracket member to secure the stabilizer attaching assembly to the wheelchair foot plate.

7. A foot stabilizer assembly according to claim 1, wherein the attachment portions of the front and rear bracket members each comprise a U-shaped channel portion for receiving and engaging an edge of the wheelchair foot plate in response to the separation between the front and rear bracket members being reduced.

8. A foot stabilizer according to claim 7, wherein the U-shaped channel portions of the front and rear bracket members are located at upper surfaces of the bracket members, so that the bracket members attach to the wheelchair foot plate from beneath.

9. A foot stabilizer according to claim 1, wherein the attaching assembly further comprises means for maintaining alignment of the front and rear bracket members as the separation between the bracket members is reduced.

10. A foot stabilizer according to claim 9, wherein the means for maintaining alignment of the front and rear bracket members comprises parallel channels on first and second side edges of the front bracket member that receive first and second side edges of the rear bracket member in sliding engagement therewith.

11. A foot stabilizer assembly according to claim 1, further comprising means for adjusting the separation between the foot stabilizer and the heel guard when the assembly is attached to the wheelchair foot plate.

12. A foot stabilizer assembly according to claim 11, wherein the means for adjusting the separation between the foot stabilizer and the heel guard comprises a longitudinally extending shank on the foot stabilizer that is slidingly received in a channel on the front bracket member, and a longitudinally extending leg on the heel guard that is slidingly received in a channel on the rear bracket member.

13. A foot stabilizer assembly according to claim 12, wherein the means for adjusting the separation between the foot stabilizer and the heel guard further comprises means for fixing the shank of the foot stabilizer in the channel of the front bracket member and the leg of the heel guard in the channel of the rear bracket member, so as to maintain the foot stabilizer and heel guard at a desired separation.

14. A foot stabilizer according to claim 13, wherein the means for fixing the shank of the foot stabilizer and the leg of the heel guard comprises threaded that extend through the channels on the front and rear bracket members for being tightened so as to hold the shank and leg at fixed positions in the channels.

15. A foot stabilizer assembly for attachment to a wheelchair foot plate comprising:

(a) a foot stabilizer having a covering sized to be positioned over the front portion of a foot on the wheel chair foot plate;

(b) a heel guard having an arcuate-shaped plate with its concave side positioned to face the back of a heel of the foot on the wheelchair foot plate; and (c) a stabilizer attaching assembly comprising a rear bracket member attachable to the wheelchair foot plate and a front bracket member attachable to the wheelchair foot plate, the front bracket member being separated from the rear bracket member, and a connector attachable to the rear bracket member and the front bracket member to reduce the separation between the rear bracket member and the front bracket member to secure the stabilizer attaching assembly to the wheelchair foot plate, the connector comprising a first lug attached to the rear bracket member and a second lug attached to the front bracket member, the rear bracket member and the front bracket member being provided with openings aligned with one another when the rear bracket member and the front bracket member are attached to the wheelchair foot plate to permit an adjusting bolt operatively affixed through the aligned openings to reduce the separation between the rear bracket member and the front bracket member to secure the stabilizer attaching assembly to the wheelchair foot plate.

* * * * *